US006898914B2

(12) United States Patent
Folsom et al.

(10) Patent No.: US 6,898,914 B2
(45) Date of Patent: May 31, 2005

(54) MUNTIN GRID ASSEMBLY AND MOUNTING SYSTEM

(76) Inventors: Peter Folsom, 2 Village La., Bronxville, NY (US) 10708; Helmut Schmidt, 9 Woodglen Way, Unionville, Ontario (CA), L3R 3A8

( * ) Notice: Subject to any disclaimer, the term of this patent is extended or adjusted under 35 U.S.C. 154(b) by 28 days.

(21) Appl. No.: 10/428,726

(22) Filed: May 2, 2003

(65) Prior Publication Data

US 2004/0216402 A1 Nov. 4, 2004

(51) Int. Cl.[7] ..... E06B 3/00

(52) U.S. Cl. ..... 52/656.8; 52/456; 52/663; 52/665; 52/204.61; 403/400

(58) Field of Search ..... 52/455, 456, 663, 52/665, 666, 667, 656.8, 656.9, 311.3, 204.61; 403/247, 400; 49/50

(56) References Cited

U.S. PATENT DOCUMENTS

| | | | | | |
|---|---|---|---|---|---|
| 2,927,355 | A | * | 3/1960 | Rasmussen | 52/206 |
| 3,108,336 | A | | 10/1963 | Tate et al. | |
| 3,254,465 | A | * | 6/1966 | Brengman et al. | 52/455 |
| 3,381,431 | A | * | 5/1968 | Jacobson | 52/309.1 |
| 3,678,651 | A | * | 7/1972 | Hicks | 52/204.61 |
| 3,951,320 | A | * | 4/1976 | Bott | 224/326 |
| 4,060,950 | A | | 12/1977 | Rackard et al. | |
| 4,106,239 | A | | 8/1978 | Bancroft et al. | |
| 4,241,556 | A | * | 12/1980 | Bursk | 52/455 |
| 4,437,284 | A | | 3/1984 | Cribben et al. | |
| 4,644,721 | A | | 2/1987 | Bloomquist et al. | |
| 4,652,472 | A | | 3/1987 | Davies | |
| 4,845,911 | A | * | 7/1989 | Winston et al. | 52/456 |
| 4,970,840 | A | | 11/1990 | Ouellette et al. | |
| 4,989,384 | A | | 2/1991 | Kinghorn et al. | |
| 5,040,347 | A | * | 8/1991 | Valvis | 52/204.591 |
| 5,048,252 | A | | 9/1991 | Osborn | |
| 5,088,255 | A | * | 2/1992 | Emanuel | 52/395 |
| 5,226,919 | A | * | 7/1993 | Milligan | 52/314 |
| 5,291,710 | A | | 3/1994 | Golen | |
| 5,325,579 | A | | 7/1994 | Baier | |
| 5,331,727 | A | | 7/1994 | Golen | |
| 5,345,743 | A | | 9/1994 | Baier | |
| 5,351,459 | A | | 10/1994 | Kassl et al. | |
| 5,437,133 | A | | 8/1995 | Pliml | |
| 5,533,314 | A | | 7/1996 | Kunert | |
| 5,860,346 | A | | 1/1999 | McKeegan, Jr. et al. | |
| 6,021,701 | A | | 2/2000 | McKeegan, Jr. et al. | |
| 6,131,356 | A | | 10/2000 | Gieseke | |
| 6,177,156 | B1 | | 1/2001 | Glover et al. | |
| 6,230,456 | B1 | | 5/2001 | Merchlewitz | |
| 6,244,012 | B1 | | 6/2001 | McGlinchy et al. | |
| 6,286,288 | B1 | | 9/2001 | France | |
| 6,301,843 | B1 | * | 10/2001 | Silverman | 52/204.5 |
| 6,393,955 | B1 | | 5/2002 | McKeegan, Jr. et al. | |
| 6,425,221 | B1 | | 7/2002 | Reichert | |
| 6,438,819 | B1 | | 8/2002 | McGlinchy et al. | |
| 6,718,704 | B2 | * | 4/2004 | Plummer et al. | 52/204.61 |
| 2001/0034990 | A1 | | 11/2001 | Reichert | |
| 2002/0046545 | A1 | | 4/2002 | France | |
| 2002/0102370 | A1 | | 8/2002 | Glover et al. | |
| 2003/0159374 | A1 | * | 8/2003 | Burgess | 52/204.61 |

* cited by examiner

*Primary Examiner*—Brian E. Glessner
(74) *Attorney, Agent, or Firm*—Onofrio Law; Dara L. Onofrio, Esq.

(57) ABSTRACT

A muntin bar assembly for a window or door including a peripheral frame; a continuous surface contained within the frame; at least one continuous muntin bar and at least two discontinuous muntin bars on at least one side of the surface. The continuous muntin bar and discontinuous muntin bars both contain a continuous recessed portion on their underside and are connected together using an intersection clip having a spring-type arrangement which forms an intersection of the bars. The intersection clip has a raised central section that fits within the recessed portion of the continuous muntin bar; and further has two extensions positioned at opposite sides from the central portion which permit engagement of the discontinuous muntin bars to form the muntin assembly. An end clip is also included for attachment and alignment of the inner and outer assembly muntin bar ends and has a U-shape that fits over the edges of the surface for aligning and attaching the inner and outer assembly muntin bars.

17 Claims, 7 Drawing Sheets

MUNTIN BAR ASSEMBLY

MUNTIN BAR ASSEMBLY ON GLAZING ELEMENT

MUNTIN BAR ASSEMBLY AND GLAZING ELEMENT INSTALLED IN FRAME

CROSS SECTION THROUGH MUNTIN BAR ASSEMBLY, GLAZING ELEMENT AND FRAME

MUNTIN GRID ASSEMBLY AND MOUNTING SYSTEM

FIELD OF THE INVENTION

The present invention relates to a muntin bar assembly for windows or doors, and their mounting into a frame.

BACKGROUND OF THE INVENTION

Muntin grids consist of lineal elements that are destined to subdivide an opening created by a perimeter frame work assembly, particularly in the context of windows and doors. Such assemblies are usually referred to as divided lights.

As it is known in the art, said muntin grids traditionally formed a structural assembly with the perimeter framework, creating a multitude of openings that had to be closed by a multitude of smaller panes of glass. Surface-applied muntin grids within a perimeter framework, however, provide the advantage of using only a single glazing element to close the opening. In the case of a glazing element made from more than one pane of glazing, such as an insulating glass unit, an additional muntin grid can be installed internally in-between the panes, to create a likeness to the traditional divided lights.

In the context of windows and doors, the said perimeter framework, which retains the glazing, is called either a sash frame or a main frame, depending on its intended function. Sashes are typically mobile elements within a main frame which retain the glazing and hold the necessary working hardware to allow them to slide, pivot, tilt, lock, etc. for ventilation, egress and cleaning purposes. In the context of doors, the mobile element consisting of the perimeter frame and the glazing is usually referred to as a panel.

In the case of fixed glazing assemblies, the perimeter frame, which retains the glazing, is called the main frame. Such products are referred to either as fixed windows or as door side-lights.

Muntin grids are intersecting bar assemblies that are installed in aligned and parallel relationship with the plain of the glazing for the purpose of creating the appearance of individual, divided lights.

In the manufacture of a muntin grid assembly, one typically starts with lineal profiles. These profiles are designed to incorporate specific functional features related to the assembly and mounting processes and to display a certain traditional look.

Furthermore, although many materials of construction are conventionally utilized for the manufacturing of muntins, such as wood, thermoplastics and aluminum, this invention emphasizes the use of fiber-reinforced, duroplastic lineals, such as pultrusions, because of their superior stiffness, their low thermal expansion and contraction rate and their excellent corrosion resistance.

Muntin grids are commonly made of profiles that intersect at right angles, creating rectangular openings. However, muntin grid profiles can be designed to intersect at angles other than 90°, producing a diamond-shape grid pattern.

Fabrication of muntin grid assemblies are done in several different ways. The grids may be assembled by the use of individual muntin bars, the lengths of which correspond to the respective length of each side of the opening that they create. This method results in a structurally weaker assembly making it difficult to align the grid with its intended pattern. Stronger grids are assembled using continuous profiles in both directions. At intersections, bars are being notched or pierced to interlock with each other in an overlapping or penetrating fashion. U.S. Pat. No. 4,060,950, to Rackard et al.; U.S. Pat. No. 4,652,472 to Davies; U.S. Pat. No. 4,989,384 to Kinghorn et al. and U.S. Pat. No. 6,425,221 to Reichert are representative of these types of assemblies. However, this method is only practical when the grid profile is of a rectangular, cross-sectional box shape.

The assembly method preferred in this invention is the use of continuous muntin bars in one direction and short, individual lengths of muntin bars in the other direction. This method provides the grid with ample stiffness, while still allowing for the use of decorative, complex muntin bar profile shapes to be mated at the intersections. As it is known in the art, and described in U.S. Pat. No. 4,437,284 to Cribben et al.; U.S. Pat. No. 4,970,840 to Ouellette and U.S. Pat. No. 6,244,012 to McGlinchy, this type of mating depends on reliable connection methods for the purpose of attaching the short muntin bars to the continuous ones which require precise and complex machining of the mating portions of said muntin bars. The invention provides substantial simplification of the fabrication of such intersections with the provision of a uniquely structured intersection clip.

To achieve this simplification the invention discloses use of a spring-type clip arrangement for connecting together the continuous and the intersecting short muntin bars. A spring clip is designed to lock its central portion through snap-engagement to the continuous muntin profile. The clip extends arms beyond the continuous bar on opposite sides. Each extension arm serves as a spring-type clip for snap-engagement with the mating shorter muntin bars.

For the purpose of creating the intersection, this method eliminates the need for any machining of the continuous muntin bars and it limits the preparation of the short muntin bars to the machining of their mating interfaces.

Muntin grids can be mounted as removable elements or as permanently attached assemblies. Removable grids commonly are snap-fitted to the perimeter frame as disclosed in U.S. Pat. No. 4,644,721 to Bloomquist et al.; U.S. Pat. No. 5,437,133 to Pliml and U.S. Pat. No. 6,230,456 to Merchlewitz. Alternatively, they are equipped with attachment means to be retained within the perimeter frame as disclosed in U.S. Pat. Nos. 4,970,840 to Ouellette, and U.S. Pat. No. 5,048,252 to Osborn.

Permanent grids, which are positioned within the space between glass panes of a sealed glazing unit, usually are mechanically attached to the spacer bar along the perimeter by the use of pins or clips as described in U.S. Pat. No. 6,131,356, Gieseke and U.S. Pat. No. 6,425,221 to Reichert. External permanent grids are most often mechanically attached to the perimeter frame as disclosed in U.S. Pat. No. 4,644,721 to Bloomquist et al.; U.S. Pat. No. 5,437,133, Pliml and U.S. Pat. No. 6,230,456 to Merchlewitz and may be integral with said perimeter frame as described in U.S. Pat. No. 5,331,727 to Golen. Commonly, the muntin bars are bonded to the adjacent glass surface for permanent retention.

As it is known in the art and described in U.S. Pat. No. 4,989,384 to Kinghorn et al. and U.S. Pat. No. 5,291,710 to Golen, muntin grid assemblies can be provided with a continuous outer border profile that closes the perimeter openings and described in. It provides greater stiffness and eases alignment of the muntin bars. However, the width of the outer border projects into the glazing area and reduces the vision area of a window or door. Therefore, it is more desirable to make the outer perimeter of the grid pattern open, leaving the ends of the muntin bars unsupported.

Another aspect of the present invention relates to the attachment of the free ends of the muntin grid assembly.

Under currently known methods the proper alignment of said free ends is difficult. This difficulty increases when exterior and interior muntin grids are being used in combination to achieve more likeness with true divided lights. The aesthetics of muntin grids can be enhanced further by the addition of an internal grid, positioned in between the glass panes of a sealed glazing unit as disclosed in U.S. Pat. No. 5,345,743 to Baier and U.S. Pat. No. 6,425,221 to Reichert. The use of exterior, interior and internal muntin grids in combination amplifies the problem of grid alignment.

The essence of this aspect of the invention is the creation of a means for the attachment and the alignment of muntin bar free ends of multiple grid assemblies used in combination. As it is known in the art, free muntin bar ends can be attached individually to a perimeter frame by mechanical means, such as fasteners, pins and clips. Said means are exclusively designed to serve for the attachment of a singular grid assembly only. Representative patents include U.S. Pat. No. 3,108,336 to Tate; U.S. Pat. No. 4,437,284 to Cribben; U.S. Pat. No. 4,644,721 to Bloomquist et al.; U.S. Pat. No. 4,970,840 to Ouellette; U.S. Pat. No. 5,048,252 to Osborn; U.S. Pat. No. 5,437,133 to Pliml; U.S. Pat. No. 6,131,356 to Gieseke; U.S. Pat. No. 6,230,456 to Merchlewitz and U.S. Pat. No. 6,425,221 to Reichert.

The invention provides a uniquely structured end clip for the attachment and alignment of a plurality of muntin grids in combination. The end clip includes an attachment means that consists of a snap-type clip arrangement that overlaps the glazing edges for the purpose of aligning and retaining the free ends of the respective muntin grid assemblies. The clip consists of a "U"-shaped central portion which is destined to straddle the edge of the glazing. The end-portions of the clips project beyond the engagement of the glazing edge within the sash frame, or within the main frame, thus presenting aligned attachment means to the free ends of the muntin grids at both, the outer and the inner faces of the glazing. Furthermore, when aligning said perimeter clips with the ends of the additional, internal grids, this will ensure the perfect correspondence of all muntin grid assemblies.

Use of adhesive means for the bonding of muntin grids directly or indirectly to glazing surfaces has been described in U.S. Pat. No. 5,345,743 to Baier or U.S. Pat. No. 4,437,284, Cribben et al., respectively. This can be achieved through various materials, i.e. liquid adhesives or dry adhesive tapes. Double-adhesive, pressure sensitive tapes are the most commonly used materials. The use of double-adhesive tape, in combination with the end clip snap-type arrangements for the purpose of enhancement of the retention of the muntin grid assembly within a sash-frame or main frame, represents a further advancement of the preferred assembly method. However, it is important to understand that by overlapping the junctions of the grid profiles with an application of the double-adhesive tape, covering the mating, short profiles from one side of the grid to the other, the whole grid assembly becomes more rigid and easier to manipulate during the application process, thus greatly assisting with the alignment of the grids.

It is a broad object of the present invention to provide a muntin grid assembly and a means of mounting said muntin grid into a frame work assembly that can overcome the prior art deficiencies and shortcomings.

It is another object of the present invention to provide a muntin grid assembly and a means of mounting said muntin grid into a frame work assembly in a simple, yet reliable manner with a minimal effort and low manufacturing costs.

It is a specific object of the present invention to provide a uniquely structured intersection clip having a spring-type arrangement for connecting together continuous and intersecting short muntin bars.

It is another specific object of the present invention to provide a uniquely structured end clip having a snap-type arrangement for attachment and alignment of a plurality of muntin grids in combination. The snap-type arrangement overlaps the glazing edges for the purpose of aligning and retaining the free ends of the respective muntin grid assemblies.

SUMMARY OF THE INVENTION

In general, the invention provides a muntin bar assembly for a window or door. The assembly includes a peripheral frame; a surface contained within the frame and at least one continuous muntin bar and at least two discontinuous muntin bars on at least one side of the surface. The continuous muntin bar and the discontinuous muntin bars both contain a continuous recessed portion on their underside. A structural intersection of said muntin bars is formed by the use of an intersection clip. The intersection clip used in the invention includes a raised central section that engages within the recessed portion of the continuous muntin bar; and further has two extensions positioned at opposite sides from the central portion which permit engagement of the discontinuous muntin bars to form the muntin assembly.

In a preferrred embodiment the intersection clip positions the discontinuous muntin bars at a 90 degree angle from the continuous muntin bar to form a grid pattern.

In another embodiment a second muntin assembly on the opposite side of the glazing surface is provided such that one assembly is an outer assembly and the opposite assembly is an inner assembly. An end clip, which is part of the invention, is used for attachment and for alignment of the inner and outer assembly muntin bar ends.

The invention end clip has a U-shape which fits over the edges of the glazing surface for aligning and attaching the inner and outer assembly muntin bars. In a preferred embodiment the surface is a single glazing element.

In particular the surface used in the invention is a transparent and/or translucent glazing material selected from the group consisting of glass, ceramics or polymeric materials.

The invention also includes an intersection clip for connecting multiple muntin bars each having a continuous recessed portion on their underside. The intersection clip is comprised of a spring clip element having a raised central portion formed by opposing surfaces. The opposing surfaces have wing-like extensions protruding beyond the surfaces which snap into the recessed portion of a first muntin bar and also have a pair of extensions positioned at opposite sides of the raised central portion. These extensions have raised sides in opposition to each other to form protruding ridges which snap into the recessed portion of a second and third muntin bar.

The intersection location formed by attaching the multiple bars is adjustable. The intersection clip is preferably a material selected from the group consisting of elastic material, steel, stainless steel or polymeric material. Most preferably the material is stainless steel.

The invention includes an end clip for attachment and alignment of a plurality of muntin grids in combination. In one embodiment of the invention an inner and outer muntin bar assembly is on opposite sides of a substrate. The muntin bar assemblies comprise muntin bars having a continuous recessed portion on their underside. The end clip has a U-shape body formed by opposing surfaces and a connecting web portion which fits over the edges of the substrate to permit alignment of the inner and outer muntin grids.

The opposing surfaces of the U-shaped body of the end clip further has an extension with raised sides in opposition to each other to form protruding ridges which engage the recessed portion of the muntin bars and secure their attachment.

The connecting web portion further has a thinning recess to limit thermal conduction through the material and also has a fold to permit adjustment of width according to substrate thickness.

The end clip is preferably a material selected from the group consisting of elastic material, steel, stainless steel or polymeric material. Most preferably the material is stainless steel.

The use of adhesives is optional for the attachment of muntin grids. Their application can be local, i.e. at intersections and/or bar ends, but more commonly, cover the whole length of contact surface of each bar of the muntin grid and the substrate.

Other objects, features and advantages of the present invention will be apparent when the detailed description of the preferred embodiments of the invention are considered with reference to the drawings, which should be construed in an illustrative and not limiting sense as follows:

DETAILED DESCRIPTION OF THE INVENTION

Figure 1:
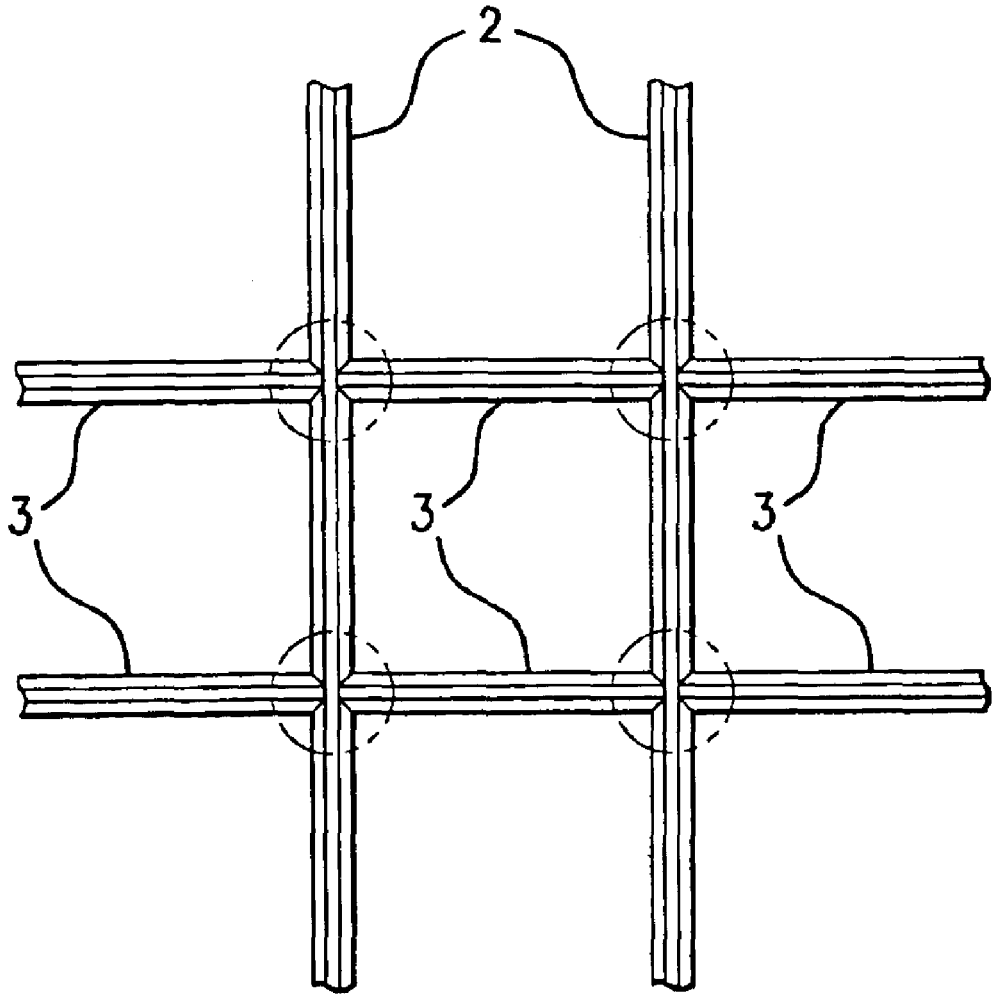
FIG. 1 is a front view of a muntin bar assembly, illustrating the continuous muntin bars being intersected by short muntin bar parts. The encircled intersections signify the location of application of the intersection clips.

According to the present invention, and as illustrated generally in FIG. 1, there is provided an intersection clip having a spring clip element 1 for the creation of cross-shaped intersections between a continuous muntin bar 2 and two short muntin bar parts 3 positioned on opposite sides of said continuous muntin bar.

Figure 2:
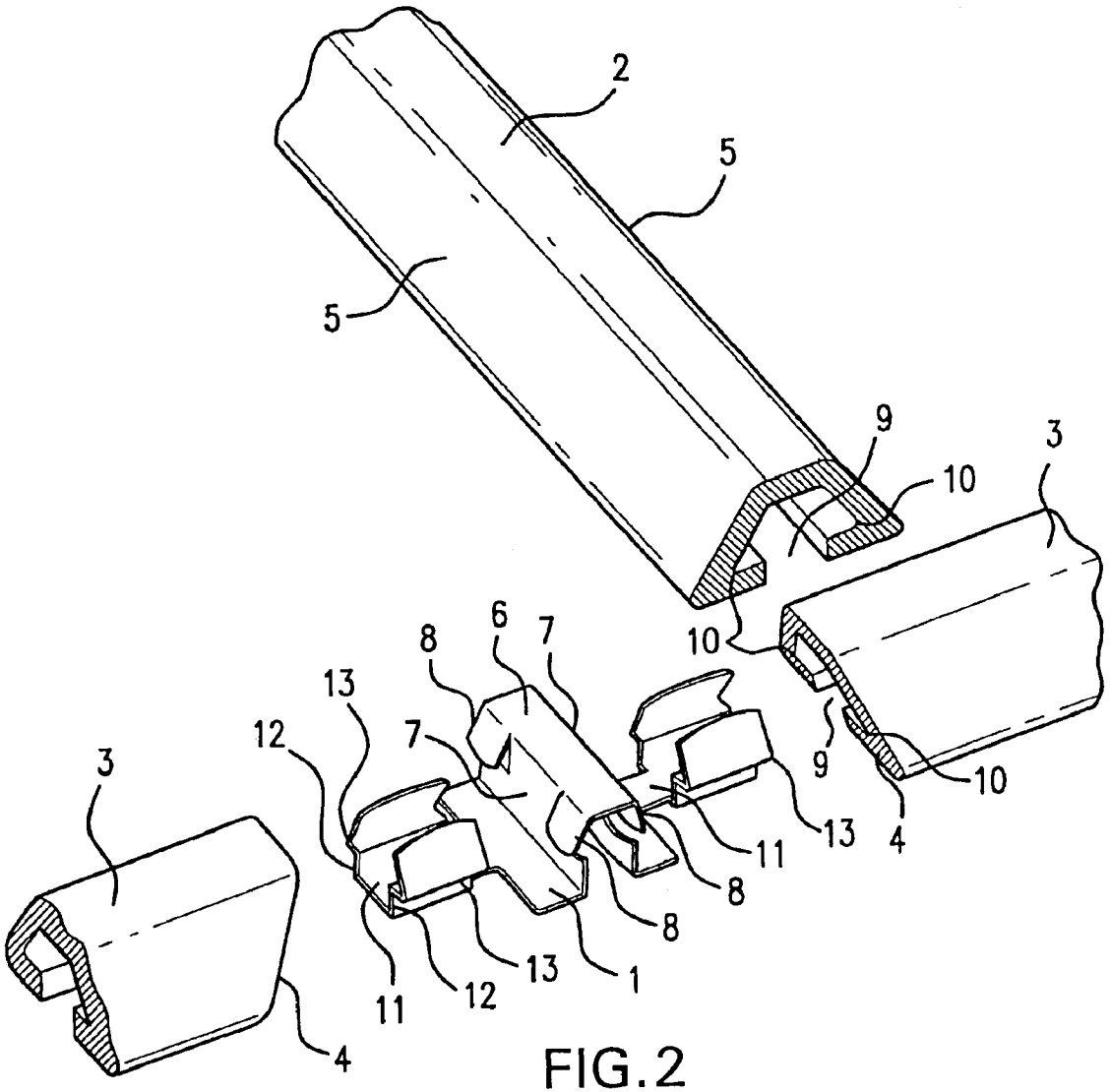
FIG. 2 is an illustration of the intersection clip and the continuous muntin bar and the short muntin parts prior to assembly.

As illustrated in more detail in FIG. 2, the short muntin bar parts having at least one of its extremities 4 prepared for mating with said continuous muntin bar shape 5. The spring clip element 1, has a raised central portion 6 formed mainly by opposing surfaces 7. The opposing surfaces having wing-like extensions 8 which protrude beyond the surfaces. These wings preferably act like springs to facilitate the engagement of the central portion 6 of the intersection clip 1 into the central recess 9 of the continuous muntin bar 2.

It is preferable that the recess, 9 in the muntin bars have opposing and undercut side walls 10 to allow for a positive retention of the intersection clip by its wings 8. The intersection clip has a pair of extensions 11 positioned at opposite sides of raised central portion 6. These extensions have raised sides 12 in opposition to each other. The raised sides form protruding ridges 13. These raised sides preferably act like springs to facilitate their engagement into the central recess 9 in the extremities of the mating, short muntin bar parts 3. The protruding ridges penetrate the retaining undercuts 10, thus securing the assembly of the intersection.

Figure 3:
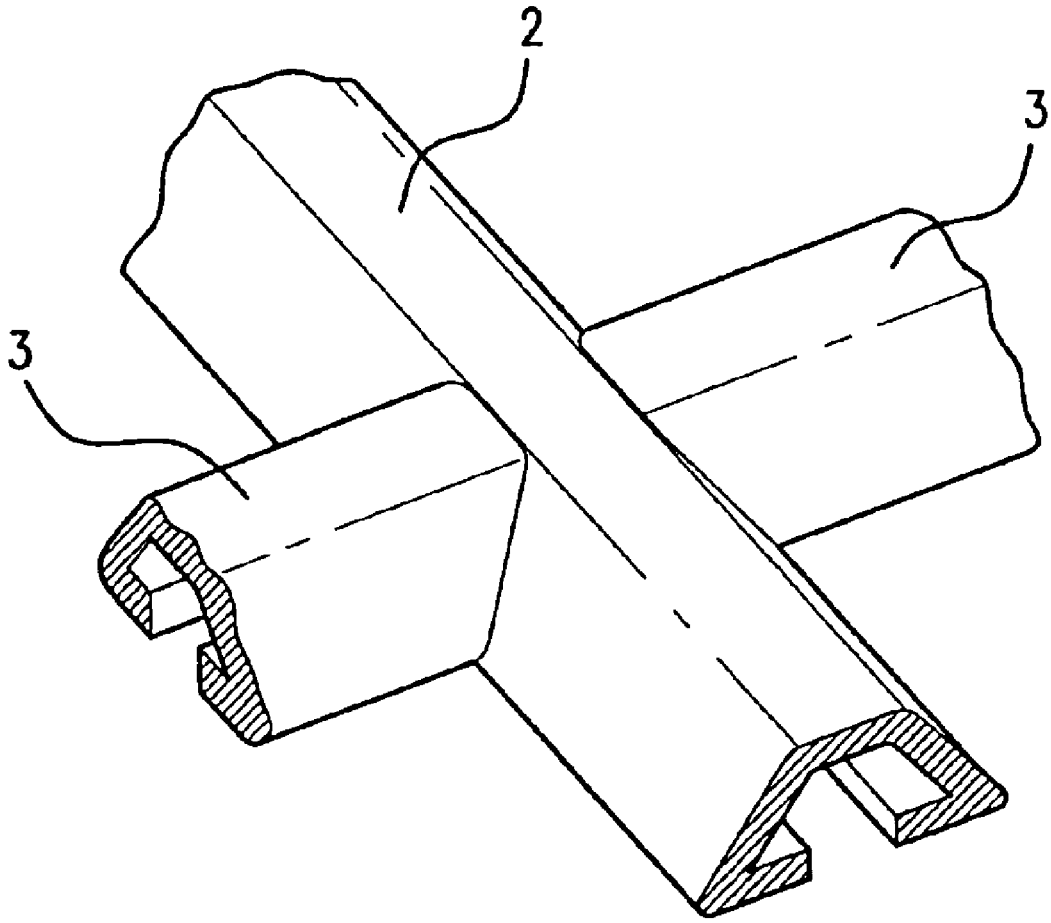
FIG. 3 is an illustration of the assembled continuous muntin bar and the short muntin parts.

FIG. 3 illustrates the assembled continuous muntin bar 2 and short muntin parts 3 using the intersection clip of the invention. This view clearly shows that the only preparation necessary for assembly of the short parts is the shaping of their end faces for mating with the contact faces of the continuous bars.

Figure 4A:
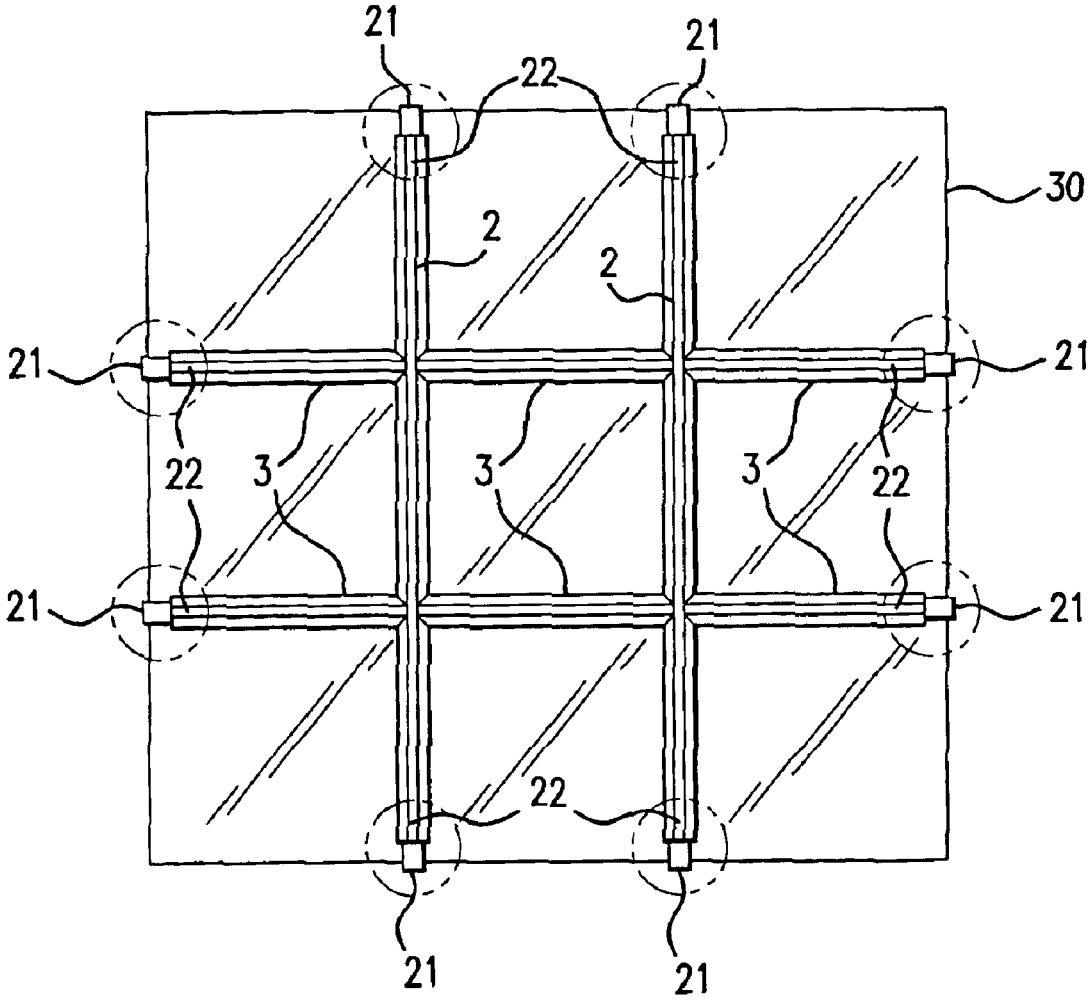
FIG. 4A is a front view of a muntin bar assembly installed on a glazing element. The encircled muntin bar end points signify the location of application of the end clips.
Figure 4B:
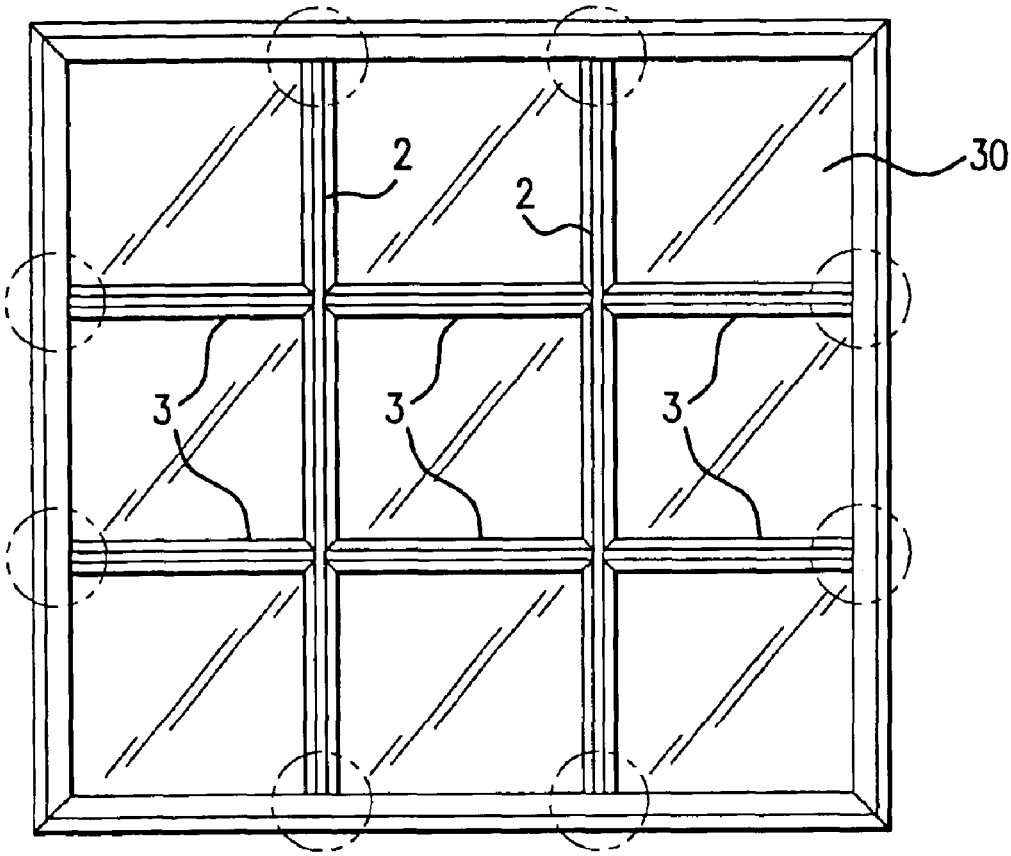
FIG. 4B is a front view of a muntin bar assembly and the glazing element installed in a frame. The encircled areas signify the location of application of the end clips.

In another embodiment of the invention, and as generally illustrated in FIGS. 4A and 4B there is further provided an end clip having a spring clip element 21 for the attachment of the free ends 22 of the muntin bars.

Figure 5:
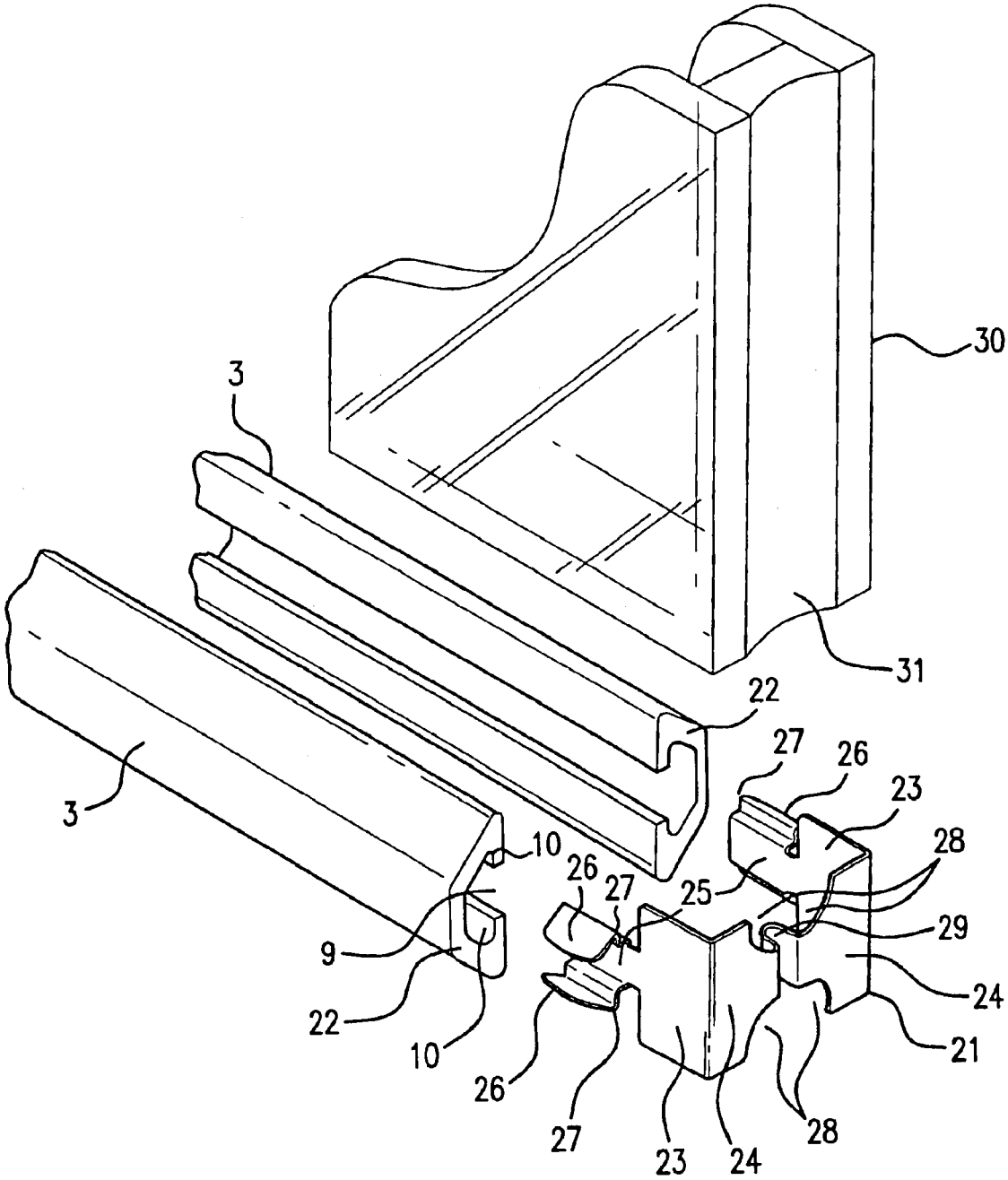
FIG. 5 is an illustration of the end clip, the muntin bar free ends, prior to assembly and the glazing element.

FIG. 5 illustrates a detailed view of this embodiment showing the spring clip element, referred to as end clip 21, having preferably a "U"-shaped body formed by opposing surfaces 23 and a connecting web portion 24. The "U"-shaped body is preferably sized to snugly overlap the edges of glazing element 30 for the purpose of aligning and of attaching outer and inner muntin bar ends 22.

Figure 6:
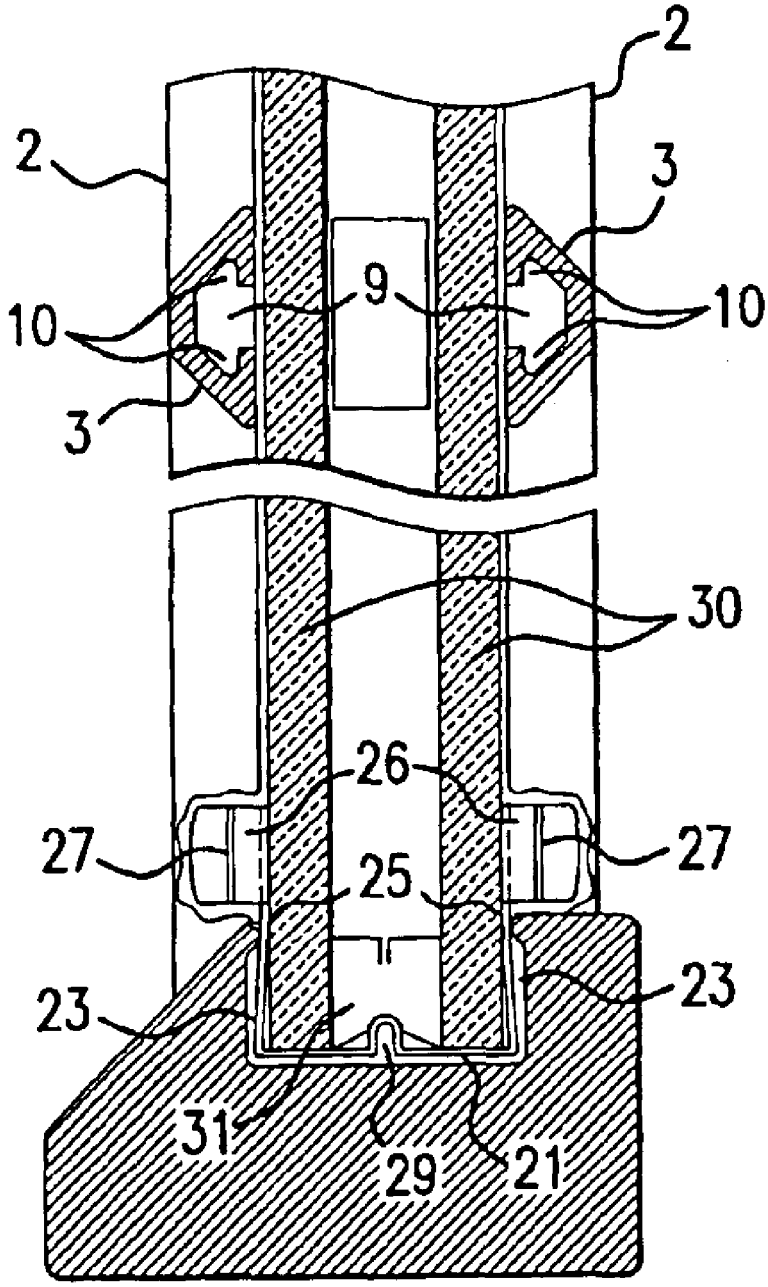
FIG. 6 is a cross sectional view of the assembled muntin bars, end clips, the glazing element and the frame.

As illustrated in FIG. 6 opposing surfaces 23 each have an extension 25 with raised sides 26 in opposition to each other. The raised sides form protruding ridges 27, and preferably acting like springs to facilitate their engagement into the central recess 9 in the extremities of the muntin bars 2 and 3. The protruding ridges penetrate the retaining undercuts 10 of the muntin bars, thus securing their attachment. The connecting web portion 24 preferably having thinning recesses 28 to limit thermal conduction through the material. The web portion, preferably, has a fold 29 to achieve adjustment of its width in correspondence with glazing thickness variations. When the end clip is positioned on the edge of an insulating glass unit 30, said fold 29 preferably protruding into its perimeter sealant material 31 to anchor the end clip in its proper position.

Preferably, the intersection clip 1 and the end clip 21 are made of thin, elastic, spring-like material, such as spring steel. Preferably the intersection clips and end clips of the invention are made of stainless steel. In addition, the clips can be made of other non-corroding materials, such as plastics, or corrosion resistant materials, such as coated and/or plated metals.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention as set forth in the following claims.

What is claimed is:

1. A muntin bar assembly for a window or door comprising:

a peripheral frame;

a continuous surface contained within said frame;

at least one continuous muntin bar and at least two discontinuous muntin bars on at least one side of said surface;

wherein said continuous muntin bar and said discontinuous muntin bars both contain a continuous recessed portion on their underside and are connected together using an intersection clip having a spring-type arrangement which forms an intersection of the bars;

said intersection clip comprises a raised central section that fits within the recessed portion of said continuous muntin bar; and further comprises two extensions positioned at opposite sides from said central portion that fit within the recessed portion of said discontinuous muntin bars to form the muntin assembly.

2. The muntin bar assembly according to claim 1, wherein said intersection clip positions said discontinuous muntin bars at a 90 degree angle from said continuous muntin bar to form the muntin assembly.

3. The muntin bar assembly according to claim 1, further comprising a second muntin assembly on the opposite side of said surface such that one assembly is an outer assembly and the opposite assembly is an inner assembly.

4. The muntin assembly according to claim 3, further comprising an end clip for attachment and for alignment of said inner and outer assembly muntin bar ends.

5. The muntin assembly according to claim 4, wherein said end clip comprises a U-shape which fits over the edges of said surface for aligning and attaching said inner and outer assembly muntin bars.

6. The muntin assembly according to claim 1, wherein said surface is a single glazing element.

7. The muntin assembly according to claim 1, wherein said surface is comprised of transparent and/or translucent glazing material selected from the group consisting of glass, ceramics or polymeric materials.

8. The muntin assembly according to claim 1 wherein said intersection clip is comprised of a material selected from the group consisting of elastic material, steel, stainless steel or polymeric material.

9. The muntin assembly according to claim 4 wherein said end clip is comprised of material selected from the group consisting of elastic material, steel, stainless steel or polymeric material.

10. The muntin assembly according to claim 4 wherein said end clip and said intersection clip are stainless steel.

11. An intersection clip for connecting multiple muntin bars each having a continuous recessed portion on their underside comprising:

a spring clip element having a raised central portion formed by opposing surfaces;

wherein said opposing surfaces having wing-like extensions protruding beyond said surfaces which snap into the recessed portion of a first muntin bar; and a pair of extensions positioned at opposite sides of said raised central portion;

wherein said extensions have raised sides in opposition to each other to form protruding ridges which snap into the recessed portion of a second and third muntin bar.

12. The intersection clip according to claim 11, wherein an intersection location formed by attaching the multiple bars is adjustable.

13. The intersection clip according to claim 11, wherein said clip is comprised of materials selected from the group consisting of of elastic material, steel, stainless steel or polymeric material.

14. The intersection clip according to claim 11 wherein said clip is stainless steel.

15. An end clip for attachment and alignment of a plurality of muntin grids in combination comprising:

an inner and outer muntin bar assembly on opposite sides of a substrate, wherein the muntin bar assemblies comprise muntin bars having a continuous recessed portion on their underside;

wherein the end clip comprises a U-shape body formed by opposing surfaces and a connecting web portion which fits over the edges of the substrate to permit alignment of the inner and outer muntin grids;

said opposing surfaces of the U-shaped body further comprise an extension with raised sides in opposition to each other to form protruding ridges which engage the recessed portion of the muntin bars and secure their attachment.

16. The end clip according to claim 15 wherein said connecting web portion further comprises a thinning recess to limit thermal conduction through the material.

17. The end clip according to claim 15 wherein said connecting web portion further comprises a fold to permit adjustment of width according to substrate thickness.

* * * * *